United States Patent [19]

Edwards et al.

[11] 3,996,152

[45] Dec. 7, 1976

[54] BLEACHING COMPOSITION

[75] Inventors: James Byrd Edwards, Cincinnati; Francis Louvaine Diehl, Wyoming; Mario Stephen Marsan, Cincinnati, all of Ohio

[73] Assignee: The Procter & Gamble Company, Cincinnati, Ohio

[22] Filed: Mar. 27, 1975

[21] Appl. No.: 562,530

[52] U.S. Cl. ..... 252/186; 8/111; 252/95; 252/99; 252/187 H

[51] Int. Cl.[2] ..... C11D 3/395; C11D 7/54; D06L 3/02

[58] Field of Search ..... 252/186, 187 H, 90, 252/95, 99, 316, 317; 8/111, 79

[56] References Cited

UNITED STATES PATENTS

| | | | |
|---|---|---|---|
| 3,684,722 | 8/1972 | Hynam et al. | 252/99 |
| 3,708,260 | 1/1973 | Marshall et al. | 252/316 |
| 3,726,967 | 4/1973 | Vorsatz et al. | 252/186 |
| 3,789,002 | 1/1974 | Weber et al. | 252/316 |
| 3,843,548 | 10/1974 | James | 252/187 H |

*Primary Examiner*—Benjamin R. Padgett
*Assistant Examiner*—Irwin Gluck
*Attorney, Agent, or Firm*—Charles R. Wilson; Jerry J. Yetter; Richard C. Witte

[57] ABSTRACT

Low pH, non-starch gels containing particulate peroxygen compounds, especially diperazelaic acid, provide safe, effective and stable fabric bleaching compositions for use at alkaline pH's, e.g., in laundry baths.

17 Claims, No Drawings

BLEACHING COMPOSITION

BACKGROUND OF THE INVENTION

The present invention encompasses compositions for bleaching fabrics. More specifically, thickened compositions containing particulate peroxygen compounds, especially low pH, metal ion-free compositions containing particles of diperazelaic acid, provide stable, yet highly effective, color-safe bleaches adapted for use in laundry baths under alkaline conditions.

The most familiar method for bleaching fabrics to remove stains, especially in the context of a home laundering operation, is to add an oxidizing bleach directly to the laundering liquor. Liquid chlorine (as hypochlorite) solutions are usually employed, but solid peroxygen bleaches are also commercially available. Such bleaches are widely accepted and convenient in that they are used in the aqueous laundering bath in conjunction with the detergent, and provide the desired bleaching action concurrently with fabric laundering.

Chlorine bleaches can damage colors if not diluted properly before coming in contact with fabrics. Commercially available peroxygen bleaches are safer for use in contact with colored fabrics than chlorine bleaches, but are not as effective for removing stubborn stains. Some peroxygen compounds are potentially as efficacious as chlorine bleaches, but are unstable and have too short a shelf life for home use. Moreover, these latter peroxygen compounds can damage colors, especially if solid particles of the compounds adhere directly to colored fabrics in the presence of but small amounts of water. Under such conditions, localized color damage, or "spotting", can occur.

It has now been found that highly effective peroxygen compounds can be thickened and used to bleach fabrics in an aqueous laundry bath at alkaline pH's (e.g., in the presence of standard detergents or pre-soaks which provide a pH in the alkaline range). It has further been discovered that the thickened compositions herein can be rendered substantially free from metallic decomposition catalysts (and optionally acidified), thereby stabilizing the peroxygen compound and prolonging shelf life. When added to the alkaline laundry bath, any acid stabilizer present therein is neutralized, the peroxygen compound decomposes (presumably, to singlet oxygen) and bleaching ensues. Importantly, it has been found that, should the undiluted compositions herein inadvertently come in direct contact with fabrics, no substantial visible color damage occurs.

It is an object of this invention to provide effective fabric bleaches which are color-safe.

It is another object herein to provide stabilized, highly effective, yet color-safe peroxygen bleaches designed for through-the-wash fabric bleaching under alkaline pH's.

These and other objects are obtained herein as will be seen from the following disclosure.

The concurrently-filed application of Bradley, Ser. No. 562,531, relates to fabric bleaches thickened with starch and starch derivatives.

The concurrently-filed applications of Diehl, et al., Marsan, et al., and Bradley, et al., Ser. Nos. 562,527, 562,529 and 572,528, disclose articles comprising thickened bleaches in porous dispensers for use in laundry dryers, and the like.

PRIOR ART

The following references generally relate to peroxygen compounds and their use as oxidizing agents and/or bleaches: Canadian Patent No. 635,620 to H. W. McCune, issued Jan. 30, 1962; British Patent No. 847,702, issued Sept. 14, 1960; W. E. Parker, et al., *J. Am. Chem. Soc.*, 79, 1929 (1957); E. Searles, "Preparation, Properties, Reactions and Use of Organic Peracids and their Salts", FMC Corp., N.Y. (1964); D. Swern (ed.) "Organic Peroxides", Vol. I, Wiley-Interscience, N.Y. (1970).

Bleaches comprising hydrogen peroxide thickened with silica gel are well known in the hair bleaching art. U.S. Pat. No. 3,843,548, to R. James, issued Oct. 22, 1974, relates to clay-thickened hypochlorite bleaches.

SUMMARY OF THE INVENTION

The present invention encompasses stable, color-safe, yet effective fabric bleaching compositions, comprising:

a. an effective amount of a solid, substantially water-insoluble peroxygen compound;
b. an effective amount of a non-starch thickening agent;
c. preferably, sufficient acidifying agent to maintain the pH of the compositions in the acidic range (most preferably pH 4–6) until time-of-use; and
d. a liquid carrier (most preferably water).

One problem with the use of the more effective solid peroxygen compounds, such as the peroxyacids, as fabric bleaches is their tendency to agglomerate into a pasty mass on contact with water or alkaline detergents. Once formed, the pasty mass can adhere strongly to fabrics, even in the presence of substantial amounts of water, and the extremely high, localized concentrations of the peroxygen bleaches will cause undesirable spotting damage to fabric dyes.

The present invention is based on the discovery that substantially water-insoluble, particulate peroxygen compounds can be suspended in a thickened or gel-like carrier matrix to provide color-safe fabric bleaches. While not intending to be limited by theory, it appears that the particles of peroxygen bleach are coated by the thickened carrier. As a result of this coating action, the peroxygen compounds do not agglomerate on contact with water or alkaline detergent compositions. Moreover, the carrier matrix physically prevents contact between the fabric and the bleach particles. Water quickly disperses the thickened composition so that localized spotting does not occur.

Moreover, the peroxygen compounds used herein do not dissolve in water to any substantial extent (below about 110° F); rather, they are decomposed in the presence of base to provide an active oxygen species which performs a fabric bleaching function. Accordingly, the substantially water-insoluble and stable nature of the particulate peroxygen compounds herein (in the absence of base) adds to the color safety and shelf-life of the compositions.

Preferred compositions herein are stabilized by virtue of their freedom from substantial amounts of metallo-catalysts which lead to premature decomposition of the peroxygen compounds. The compositions herein are further stabilized to premature decomposition of the peroxygen bleaching compounds, for example, with acids. When added to an alkaline laundering bath, the acid is neutralized, the thickened carrier matrix is dispersed, the peroxygen compound decomposes, and bleaching occurs.

DETAILED DESCRIPTION OF THE INVENTION

The instant compositions comprise a solid peroxygen bleach; a non-starch thickening agent which will provide thickened compositions which retain their integrity on addition to a laundry bath, but which quickly "break" and disperse on agitation of the bath; a carrier liquid which does not substantially dissolve the solid peroxygen bleach; and, preferably, an acidic stabilizing agent. These ingredients are described, in turn, below.

Peroxygen Compound

The peroxygen bleaching agents used in the present compositions can be any of the well-known organic peroxides which are substantially water-insoluble, and which decompose under alkaline conditions to provide active (presumably, singlet) oxygen. (By "substantially water-insoluble" herein is meant a water solubility of less than about 1% wt. at room temperature.) Such organic peroxide materials include, for example, the alkyl, alkenyl, alkynyl, cycloalkyl, cycloalkenyl, aralkyl, aralkenyl and heterocyclic hydroperoxides; the acyclic, cycloalkyl and aralkyl $\alpha$-oxyhydroperoxides and the gem-dihydroperoxides; the cyclic peroxides such as 1,2,4-trioxacyclopentane; the $\alpha$-oxyperoxides; the $\alpha$-oxoperoxides; the $\alpha,\alpha'$-dioxyperoxides and $\alpha,\alpha'$-diperoxyperoxides; the $\alpha,\alpha'$-dioxoperoxides; and the $\alpha,\alpha'$-dialkoxy-$\alpha,\alpha'$-dioxoperoxides, well-known in the scientific literature. For typical listings of such compounds, see ORGANIC PEROXIDES THEIR FORMATION AND REACTIONS, E. G. E. Hawkins, D. Van Nostrand Company Inc., 1961, incorporated herein by reference.

It is to be understood that the present compositions can be prepared with any of the foregoing types of solid peroxides as the peroxygen bleaching agent, so long as the peroxide selected is substantially water-insoluble and decomposes under alkaline conditions to provide the active oxygen bleaching species. Of course, it will be appreciated that certain organic peroxides are expensive; others are difficult to prepare on a commercial scale; still others are overly toxic or decompose to toxic and/or malodorous or otherwise undesirable by-products. While such factors are not important to the functioning of the present compositions, they must be considered when selecting preferred peroxides for home use as bleaches.

The most highly preferred peroxides for use as the peroxygen bleaching agent in the present compositions are the peroxyacids. Peroxyacids are conveniently prepared by the reaction of carboxylic acids with hydrogen peroxide in the presence of sulfuric acid, and many such materials are commercially available. The peroxyacids, as a class, are quite effective bleaches. In general, peroxyacids containing at least about 8 carbon atoms are sufficiently insoluble in water for use herein. The common alkali metal and ammonium salts of the peroxyacids are, for the most part, too water-soluble and are not used in the instant compositions.

Typical monoperoxyacids (i.e., prepared from monocarboxylic acids) useful herein include alkyl peroxyacids, alkenyl peroxyacids and aryl peroxyacids. Non-limiting examples of peroxyacids useful herein include peroxymyristic acid, peroxystearic acid, peroxyoleic acid and peroxy-$\alpha$-naphthoic acid.

Typical diperoxyacids (i.e., prepared from dicarboxylic acids) useful herein include alkyl diperoxyacids, alkenyl diperoxyacids and aryl diperoxyacids. Non-limiting examples of diperoxyacids useful herein include diperazelaic acid, diperbrassylic acid, dipersebacic acid, and diperisophthalic acid. The diperoxyacids are preferred over the monoperoxyacids in that, on a mole basis, the di-acids provide two equivalents of active oxygen, whereas the mono-acids provide one.

Diperazelaic acid can be readily obtained by the reaction of hydrogen peroxide and sulfuric acid with azelaic acid, which, in turn, is obtained by the catalytic oxidation of 9,10-dihydroxystearic acid; see U.S. Pat. No. 3,855,257, issued Dec. 17, 1974, to E. P. Pultinas, Jr., incorporated herein by reference. Diperazelaic acid is preferred for use herein by virtue of its low solubility in water and superior bleaching performance.

The compositions herein can contain from 1% to 40% by weight of the peroxygen bleaching agent.

Thickening Agent

The peroxygen bleaching compositions herein are thickened, or even gelled, and are characterized by a viscosity (Brookfield) in the range of about 200 centipoise (cps) to about 100,000 cps, preferably about 1000 cps to about 20,000 cps.

The thickened bleaches are optionally prepared by thickening water or any other non-solubilizing liquid carrier, e.g., 95:5 (wt.) water-ethanol, or the like, with the non-starch thickener and blending the particulate peroxygen bleach therewith until a homogeneous composition is secured.

As in the case of most peroxygen compounds, decomposition of the bleaches herein is catalyzed by "heavy" metal ions. In order to provide storage-stable compositions, contamination by even trace amounts of metal ions is preferably avoided. Metal ion contaminants can be removed from the instant compositions by the use of well-known chelating agents; alternatively, contamination can be substantially avoided by proper selection of the thickening agent used herein.

It is well-recognized that organic thickeners are not usually selected for use in combination with solutions of peroxygen bleaches. However, as disclosed hereinabove, the peroxygen bleaching agents employed in the instant compositions are in an undissolved state and do not undesirably interact with organic thickeners. This additional advantage of the present compositions allows the formulator to select non-starch organic thickeners which are substantially free from trace amounts of metal ion contaminants.

Organic thickeners useful herein include the water-soluble gums and mucilaginous materials, excluding starches, well-known, for example, in the food arts. Non-limiting examples of such materials include various cellulose derivatives such as the carboxymethylcelluloses, hydroxypropyl cellulose, methyl hydroxybutyl cellulose, and the like, hydrolyzed proteins such as the commercially available hydrolyzed keratins, glutens, polyvinylalcohol, polyvinylpyrrolidone, and the like.

Natural gums such as gum arabic, carrageenan and the various agars obtainable from seaweed are useful thickeners herein, but usually contain high concentrations of heavy metal cations such as magnesium and iron. When using such thickeners herein, it is preferred that metal ion contaminants be sequestered by the addition of chelating agents such as sodium pyrophosphate, citrate, etc.

When selecting an organic thickener for use in the present compositions it is most preferred to choose a material which is substantially free from metal ion contaminants. Substantially metal ion-free organic thickeners include, for example, the well-known cellulose derivatives which are obtainable from wood pulp or cotton linters.

Various other organic polymers are also useful thickeners herein. Such materials include the various water-swellable and water-soluble polyacrylamides, and the like. Such polymers are efficient, stable thickeners and are inherently free from metal ions.

A highly preferred organic thickener herein is carboxypolymethylene, i.e., the vinyl polymer with active carboxyl groups sold by the B. F. Goodrich Company under the name Carbopol.

From about 0.1 percent to about 10 percent, preferably 1 percent to 6 percent, by weight of composition, of the non-starch organic thickeners provides the desired thickening of the instant compositions. The Carbopols are highly preferred organic thickeners for use herein by virtue of their stability, ease-of-use, availability, and freedom from contamination by metal cations. Moreover, the Carbopols are inherently acidic and can serve as the acid stabilizer herein. The methyl hydroxyalkyl (especially hydroxybutyl) cellulosics available as Methocel are also excellent thickeners herein.

Inorganic thickeners can also be employed in the present compositions. Many inorganic thickeners, such as the clay thickeners described hereinafter, have a natural affinity for heavy metal ions of the type which can decompose peroxygen compounds. Before using such inorganic thickeners herein, it is preferred that the heavy metal ions be removed by ion exchange, for example with sodium or potassium ions. Alternatively, the heavy metal ions can be sequestered and effecitvely removed as decomposition catalysts by chelating agents. Typical chelating agents include ethylenediaminetetraacetic acid, and its alkali metal salts; nitrilotriacetic acid, and its alkali metal salts; and like chelators well-known in the art. For most purposes, about 1 part (wt.) of chelator to about 20 parts (wt.) of the inorganic thickener suffices to remove metal ion contaminants; more or less can be used, depending on the degree of metal ion contamination.

Inorganic thickening agents for the present compositions include, for example, the colloidal silicas, i.e., those having a particle size in the range from about 0.005 micron to about 0.050 micron. The colloidal silicas are further characterized by their high surface area, which is at least about 75 meters$^2$/gram. Colloidal silicas useful herein include both the "low density" and "high density" silicas described in "The Encyclopedia of Chemical Technology" 18, pp. 67 et seq. (1969) Interscience. Such particulate silicas, including silica gels, silica aerogels and other precipitated silicas, are prepared by various aqueous precipitation processes known in the art, e.g., the acid gelation of alkali silicates set forth in U.S. Pat. No. 1,297,724, and are commercially available.

While any particulate silica material having colloidal dimensions and surface areas of at least about 75–100 m$^2$/gram is suitable for use in the present compositions, the "pyrogenic" silicas are preferred. Pyrogenic silicas can be characterized as colloidal, particulate silicas prepared by the hydrolysis of silicon compounds in the vapor phase in a hot, gaseous environment. Such pyrogenic silicas have particle sizes within the range of from about 0.015 micron to about 0.020 micron and have a surface area of at least about 200 m$^2$/gram. Such pyrogenic colloidal silicas having the foregoing physical properties are superior thickeners and are preferred herein for this reason. Moreover, the pyrogenic silicas are substantially free from metal ion contamination. Pyrogenic colloidal silicas are commercially available under the tradename CAB-O-SIL from the Cabot Corporation, Boston, Mass.

From about 10 percent to about 50 percent, by weight of composition, of the colloidal silicas provides the desired thickening of the instant compositions.

Highly preferred inorganic thickening agents herein are the hydrophilic Laponite synthetic clays obtainable from Pfizer, Minerals, Pigments and Metals Division, 235 E. 42nd St., New York, N. Y. 10017. The hydrophilic Laponite clays provide excellent thickening of the present bleaching compositions and result in stable (yet readily dispersible) systems within the specified viscosity range. Although the Laponite clays are solids, they have the unique advantage of apparently drying to a thin, transparent film and are virtually undetectable, even on microscopic analysis of fabrics. Accordingly, the hydrophilic Laponite clays have the advantage over other inorganic thickeners, such as the silicas, that they do not leave noticeable solid residues on fabrics. Moreover, the hydrophilic Laponite clays having a particle size within the range of from about 0.025 micron ($\mu$) to about 50$\mu$ are known to provide anti-static and fabric softening benefits, and these benefits can now be secured concurrently with the bleaching action obtained with the instant compositions.

The Laponite clays employed herein are the hydrophilic materials available from Pfizer. These materials are prepared by the coprecipitation and hydrothermal reaction of inorganic compounds to provide a high purity natural mineral-like material reminiscent of the hectorites. X-ray analysis indicates that the Laponites are tri-layer minerals, wherein an octahedral magnesia sheet is "sandwiched" between two tetrahedral silica sheets, one on each side, via shared oxygen atoms. The two external layers of the Laponite structure contain oxygen and silicon atoms, whereas the internal layer comprises oxygen, hydroxyl, and magnesium groups. The commercially available Laponite 1001, 1501, 2001, 2101, 2501, 2601, 2002 and 2003 materials contain lithium ions in the middle layer, whereas Laponite 3000 does not.

A typical chemical analysis of hydrophilic Laponite is as follows: $SiO_2$ — 53.9%; MgO — 25.2%; $Li_2O$ — 1.5%; F — 5.3%; $Na_2O$ — 3.57%; $Fe_2O_3$ — 0.06%; $Al_2O_3$ — 0.26%; CaO — 0.07%; $SO_3$ — 0.15%; $CO_2$ — 0.19%; structural water — 6.70%.

Along with their X-ray analysis, the Laponite clays are characterized by a high surface area (as measured by nitrogen sorption) usually in the range of about 354 m$^2$/gram; a refractive index of about 1.54; a density of about 2.5 gm/ml; and a free moisture content of about 6%. The preferred Laponites are impalpable, and have a preferred particle size in the range below about 50 microns, preferably 0.025$\mu$ to about 25$\mu$. (The term "impalpable" as used to describe the clay thickeners herein means that the individual clay particles are of a size that they are not perceived tactilely. This is important, since any thickener clay which might be trapped on the bleached fabric should not render the fabric gritty.)

A further description of the hydrophilic Laponite clays along with the physical properties thereof is set forth in the technical manual entitled "Laponite for Thixotropic Gels", available from Pfizer, incorporated herein by reference. Further details regarding the Laponites are set forth in the VOLUNTARY RAW MATERIAL REGISTRATION PROGRAM — FOOD AND DRUG ADMINISTRATION — COSMETIC PRODUCTS, and appear under registration numbers 0011620; 0011621; 0011622 and 0011623.

From about 0.2 percent to about 10 percent, by weight of composition, of the Laponite clays provides the desired thickening of the instant compositions. Experimentally, Laponite 2001 is highly preferred for use herein.

Smectite clays are another class of inorganic thickeners which can be employed in the present compositions. Moreover, the preferred smectite clays also impart desirable softness benefits to fabrics concurrently with the bleaching operation.

The smectite clays can be described as impalpable, expandable, three-layer clays, i.e., alumino-silicates and magnesium silicates, having an ion exchange capacity of at least about 50 meg/100 g. of clay. The impalpable smectite clay particles are preferably within the size range below about 50$\mu$. In general, the smectite clays used herein have a particle size within the range of from about 0.025$\mu$ about 25$\mu$, with the smaller particles being preferred since they are less noticeable on fabric surfaces. The term "expandable" as used to describe clays relates to the ability of the layered clay structure to be swollen, or expanded, on contact with water. Such three-layer expandable clays are classified geologically as smectites.

There are two distinct classes of smectite-type clays useful herein. In the first, aluminum oxide is present in the silicate crystal lattice; in the second class of smectites, magnesium oxide is present in the silicate crystal lattice. The general formulas of these smectites are $Al_2(Si_2O_5)_2(OH)_2$ and $Mg_3(Si_2O)_5(OH)_2$, for the aluminum and magnesium oxide type clays, respectively. It is to be recognized that the range of the water of hydration in the above formulas can vary with the processing to which the clay has been subjected. This is immaterial to the use of the smectite clays in the present compositions in that the expandable characteristics of the hydrated clays are dictated by the silicate lattice structure. Furthermore, atom substitution by iron and magnesium can occur within the crystal lattice of the smectites, while metal cations such as $Na^+$, $Ca^{++}$, as well as $H^+$, can be co-present in the water of hydration to provide electrical neutrality. As noted hereinabove, it is preferred that the smectites be used in their protonic or alkali metal (especially $Na^+$) form to avoid the heavy metal ion catalysis of peroxygen decomposition.

The three-layer, expandable alumino-silicates useful herein are further characterized by a dioctahedral crystal lattice, while the expandable three-layer magnesium silicates have a trioctahedral crystal lattice.

As noted hereinabove, in their natural state the smectite-type clays can contain cationic counterions such as protons, sodium ions, potassium ions, calcium ion, magnesium ion, and the like. It is customary to distinguish between clays on the basis of one cation predominantly or exclusively absorbed. For example, a sodium clay is one in which the absorbed cation is predominantly sodium. Such absorbed cations can become involved in equilibrium exchange reactions with cations present in aqueous solutions. In such equilibrium reactions, one equivalent weight of solution cation replaces an equivalent weight of sodium, for example, and it is customary to measure clay cation exchange capacity (sometimes called "base exchange capacity") in terms of milliequivalents per 100 g. of clay (meg/100 g.). The cation exchange capacity of clays can be measured in several ways, including electrodialysis, by exchange with ammonium ion followed by titration, or by a methylene blue procedure, all as fully set forth in Grimshaw, *The Chemistry and Physics of Clays*, Interscience Publishers, Inc. pp. 264–265 (1971). The cation exchange capacity of a clay mineral relates to such factors as the expandable properties of the clay, the charge of the clay, which, in turn, is determined at least in part by the lattice structure, and the like. The ion exchange capacity of clays varies widely in the range from about 2 meg/100 g. for kaolinites to about 150 meg/100 g., and greater, for certain clays of the montmorillonite variety. Illite clays have an ion exchange capacity somewhere in the lower portion of the range, ca. 26 meg/100 g. for an average illite clay.

It has been determined that illite and kaolinite clays, with their relatively low ion exchange capacities, do not provide the additional fabric softening benefits characteristic of the smectites, and are not preferred for use herein. Indeed, such illite and kaolinite clays constitute a major component of clay soils. However, smectites, such as nontronite, having an ion exchange capacity of approximately 50 meg/100 g; saponite, which has an ion exchange capacity of around 70 meg/100 g.; and montmorillonite, which has an ion exchange capacity greater than 70 meg/100 g.; are useful thickeners and fabric softeners in the context of this invention. In general, the impalpable, expandable, three-layer smectite-type clays having an ion exchange capacity of at least about 50meg/100 g. are especially useful herein when used in their sodium form.

The smectite clay thickeners used herein are all commercially available. Such clays include, for example, montmorillonite, volchonskoite, nontronite, hectorite, saponite, sauconite, and vermiculite. Such clays are available under commercial names such as "fooler clay" (clay found in a relatively thin vein above the main bentonite or montmorillonite veins in the Black Hills) and various tradenames such as Thixogel No. 1 (also, "Thixo-Jell") and Gelwhite GP from Georgia Kaolin Co., Elizabeth, N.J.; Volclay BC and Volclay No. 325, from American Colloid Co., Skokie, Ill.; Black Hills Bentonite BH 450, from International Minerals and Chemicals; and Veegum Pro and Veegum F, from R. T. Vanderbilt. It is to be recognized that such smectite-type minerals obtained under the foregoing commercial and tradenames can comprise mixtures of the various discrete mineral entities. Such mixtures of the smectite minerals are suitable for use herein.

While any of the impalpable smectite-type clays having a cation exchange capacity of at least about 50 meg/100 g. are useful herein, certain clays are preferred. For example, Gelwhite GP and fooler clay are extremely white forms of smectite clays and are preferred for this reason. Likewise, Thixogel No. 1 is a preferred clay herein from the standpoint of fabric softening performance. On the other hand, certain smectite clays, such as those marketed under the name "bentonite", are sufficiently contaminated by other silicate minerals that their ion exchange capacity falls below the requisite range, and such clays are of no important use in the instant compositions.

Appropriate smectite clay minerals for use herein can be selected by virtue of the fact that smectites exhibit a true 14A X-ray diffraction pattern. This characteristic pattern, together with exchange capacity measurements, provides a basis for selecting suitable impalpable smectite-type clay minerals for use as thickeners in the present compositions.

From about 0.2 percent to about 10 percent, by weight of composition, of the smectite clays provides the desired thickening.

The clays taught for use in thickening solutions in U.S. Pat. No. 3,843,548, entitled COMPOSITIONS CONTAINING A SOURCE OF HYPOCHLORITE IONS, James, Oct. 22, 1974, incorporated herein by reference, are also useful herein, especially when employed in their alkali metal or protonic form.

Acidic Stabilizers

The thickened bleaches herein are further stabilized against decomposition by maintaining their pH in the acidic range, i.e., a pH from about 1 to about 6.9, most preferably about 4 to about 6.

The acidity of the present compositions can be established and maintained over long periods of storage using any of a variety of common acids or acidic salts. For example, inorganic acids such as hydrochloric or sulfuric acid can be added to the thickened bleaches herein to adjust the pH within the desired range. Organic acids such as acetic acid, tartaric acid, citric acid, etc., can be used in like fashion. Various inorganic acid salts such as potassium dihydrogen phosphate, sodium dihydrogen phosphate, and the like, can be also employed to acidify the instant compositions. It will be appreciated, of course, that bleach compatible acidifying agents which do not undesirably color or otherwise interact with fabrics when diluted with the 10–25 gallons of water usually present in a laundry bath, or exhibit other aesthetically undesirable properties, are most preferred herein.

The present compositions generally contain from about 0.1 percent to about 10 percent, most preferably from about 1 percent to about 3 percent by weight of the acidifying agent. Citric acid, which is innocuous and readily available, is a preferred organic acid stabilizer; potassium dihydrogen phosphate is a preferred inorganic stabilizer.

Optional Ingredients

The compositions herein can optionally contain an effective amount of various laundry adjunct and fabric treating agents not commonly found in bleaches. Such materials can be used in the present compositions without the problem of undesirable interactions with the active bleaching agent, since the bleaching agent is present in an undissolved state. Typical, optional additives herein can include fumigants, fungicides, soil suspending agents, optical bleaches, disinfectants, and the like, well-known in the detergency arts. For most purposes, such optional ingredients will comprise a minor, but effective, amount of the compositions herein, usually from about 0.05 percent to about 5 percent by weight.

A particularly desirable attribute of the present compositions is their substantial lack of odor. Again, since the bleaching compounds are in an inactivated (solid, acidified) state, they do not interact with the complex organic molecules present in desirable odoriferous and perfume compositions. Accordingly, it will be appreciated that the compositions herein can be desirably perfumed and will retain a stable odor throughout their shelf life. This important attribute of the present compositions is to be contrasted with hypochlorite bleaches, which are inherently malodorous and which cannot be effectively perfumed due to decomposition of perfume components.

Preferred bleaches of the present invention will contain an odoriferous amount, i.e., from about 0.01 percent to about 5 percent, preferably 0.05 percent to about 1 percent, by weight of a perfume component. The perfume component can comprise a relatively complex mixture of odoriferously desirably components, e.g., jasmine, rose extract, sandalwood oil, and the like. Alternatively, relatively simple perfume ingredients which connote cleansing can be used, e.g., terpene mixtures (pine oil), lemon oil, and the like.

As can be seen from the foregoing, the compositions herein comprising the solid, water-insoluble peroxygen compound, the thickening agent, the acidifying agent which maintains the pH of the composition in the acidic range until time-of-use, and the liquid carrier can be formulated from materials which are readily available. The highly preferred compositions herein are those wherein the peroxygen compound is a peroxyacid, especially diperoxyacids such as diperazelaic acid (most preferred), diperbrassylic acid, dipersebacic acid and diperisophthalic acid. In order for the compositions to be readily dispersed throughout an aqueous, alkaline laundering liquor when used, it is preferred that the solid peroxygen compounds have an average particle size below about 1500 microns. Most preferably, the diperoxyacids used herein have a particle size below about 1000 microns, generally in the range from about 1 micron to about 1000 microns. Highly preferred compositions herein contain from about 5 percent to about 35 percent by weight of the peroxygen compound, and most preferably comprise from about 15 percent to about 30 percent by weight of a diperoyacid.

The most highly preferred compositions herein by virtue of their stability and long shelf life comprise from about 15 percent to about 30 percent by weight of a particulate diperoxyacid; from about 8 percent to about 20 percent, more preferably from about 0.1 percent to about 5 percent, by weight of a carboxypolymethylene thickening agent; from about 0.1 percent to about 1 percent by weight of $KH_2PO_4$ or $NaH_2PO_4$ acidifying agent; the balance of the composition comprising water, which is a highly preferred liquid carrier herein.

When preparing optimal compositions of the present type, it is most preferred to use diperazelaic acid having an average particle diameter in the range from about 10 microns to about 1000 microns. Such compositions comprising the diperazelaic acid, optional acid, carboxypolymethylene thickening agent and water carrier also preferably contain an odoriferous amount of a perfume component. Most preferably, such optimal compositions herein will contain, as an additional component, an effective amount of a metal chelating agent, whereby the compositions are substantially free of heavy metal cations, thereby providing prolonged shelf life. Of course, the compositions herein are non-alkaline, since decomposition of the bleach is catalyzed by base.

The following examples illustrate the compositions and processes of the present invention, but are not intended to be limiting thereof.

EXAMPLE I

A bleach composition thickened with an organic thickener is as follows.

| Ingredient | % (wt.) |
|---|---|
| Diperazelaic acid* | 10 |
| Carbopol 940 | 1.2 |
| $KH_2PO_4$ | 1.0 |
| Perfume | 0.3 |
| Water | Balance |

*Passes 20, retained on 200 ASTM sieve.

The composition of Example I is prepared by simply mixing the indicated ingredients thoroughly until a thick, semi-gelatinous composition is secured.

The composition of Example I (2 oz.) is added to a washing machine with ca. 20 gallons of water and 1.25 cups of a commercial, phosphate-built laundry detergent composition. The pH of the laundering bath is ca. 9.5. Colored and white fabrics stained with coffee, tea and wine are placed in the bath.

The washing machine is operated according to manufacturer's instructions, with agitation. The composition of Example I is distributed uniformly throughout the bath by machine agitation and removes substantially all stains from the fabrics during the course of a 14-minute wash. No substantial visible damage to fabric colors is noted.

In the composition of Example I, the diperazelaic acid is replaced by an equivalent amount of diperbrassylic acid, dipersebacic acid and diperisophthalic acid of the same particle size, respectively, and excellent bleaching performance is secured.

In the composition of Example I, the Carbopol 940 is replaced by an equivalent amount of sodium carboxymethylcellulose, hydroxybutylcellulose (DS hydroxybutyl 1.3), methyl hydroxybutyl cellulose (as Methocel HB 15000) and sodium carboxymethylhydroxyethylcellulose, respectively, and equivalent results are secured.

EXAMPLE II

A bleach composition thickened with an inorganic thickener is as follows.

| Ingredient | % (wt.) |
|---|---|
| Diperazelaic acid* | 20.0 |
| Laponite 200Γ | 5.0 |
| Citric acid | 0.3 |
| Ethylenediaminetetraacetate, sodium salt | 0.5 |
| Water | Balance |

*Passes 100, retained on 150 ASTM sieve.

The composition of Example II is prepared by mixing the water, Laponite clay, citric acid and ethylenediaminetetraacetate until substantially all heavy metal cations in the resulting pH 5 gel are chelated. The particulate diperazelaic acid is thereafter added to the gel and stirring is continued until a homogeneous system is secured.

The composition of Example II is employed in the same manner as that of Example I, above, to bleach fabrics. Excellent stain removal performance without substantial visible color damage is secured. Fabrics treated with the composition of Example II are additionally provided with a soft, anti-static finish.

In the composition of Example II the pH of the gel is adjusted to ca. 5.0 using hydrochloric acid, benzoic acid, and acetic acid, respectively, and equivalent bleaching performance and product stability are secured.

In the composition of Example II, the Laponite clay is replaced by an equivalent amount of Gelwhite GP; Thixogel; and Cab-O-Sil; respectively, and superior, color-safe fabric bleaches for use at alkaline pH's are secured, respectively.

What is claimed is:

1. A fabric bleaching composition, characterized by a viscosity in the range of about 200 centipoise to about 100,000 centipoise, comprising:

a. an effective amount of a solid, substantially water-insoluble peroxygen compound;

b. an amount of a non-starch thickening agent sufficient to impart the desired viscosity to the composition;

c. sufficient acidifying agent to maintaing the pH of the composition in the acidic range until time-of-use; and d. a liquid carrier.

2. A composition according to claim 1 wherein the peroxygen compound is a peroxyacid.

3. A composition according to claim 2 wherein the peroxyacid is a diperoxyacid.

4. A composition according to claim 3 wherein the diperoxyacid is selected from the group consisting of diperazelaic acid, diperbrassylic acid, dipersebacic acid, and diperisophthalic acid.

5. A composition according to claim 4 wherein the solid diperoxyacid is characterized by an average particle diameter below about 1500 microns.

6. A composition according to claim 5 comprising from about 5 percent to about 35 percent by weight of the diperoxyacid.

7. A composition according to claim 1 wherein the thickening agent is a non-starch organic thickener and is present at a concentration of from about 0.1 percent to about 10 percent by weight.

8. A composition according to claim 7 wherein the organic thickener is selected from cellulosic, carboxypolymethylene, and proteinaceous thickeners.

9. A composition according to claim 1 wherein the thickening agent is an inorganic thickener selected from colloidal silicas, smectite-type clays and hydrophilic clays characterized in being a tri-layered mineral having an octahedral magnesia sheet between two tetrahedral silica sheets via shared oxygen atoms.

10. A composition according to claim 1 wherein the acidifying agent is $KH_2PO_4$, $NaH_2PO_4$, hydrochloric acid or citric acid.

11. A composition according to claim 1 wherein the liquid carrier is water.

12. A composition according to claim 1 comprising from about 15 percent to about 30 percent by weight of a particulate diperoxyacid; from about 0.1 percent to about 5 percent by weight of a carboxypolymethylene thickening agent; from about 0.1 percent to about 1 percent of an acidifying agent, the balance of the composition comprising water.

13. A composition according to claim 12 wherein the diperoxyacid is diperazelaic acid and has an average particle diameter in the range from about 10 microns to about 1000 microns.

14. A composition according to claim 13 containing, as an additional component, an odoriferous amount of a perfume component.

15. A composition according to claim 14 containing, as an additional component, an effective amount of a metal chelating agent, whereby the composition is substantially free of heavy metal cations.

16. A composition according to claim 7 wherein the organic thickener is methyl hydroxybutyl cellulose.

17. A composition according to claim 1 wherein the water-insoluble peroxygen compound represents from 1 percent to 40 percent by weight of the composition.

* * * * *

UNITED STATES PATENT OFFICE

CERTIFICATE OF CORRECTION

PATENT NO. : 3,996,152

DATED : December 7, 1976

INVENTOR(S) : James Byrd Edwards, Francis Louvaine Diehl and Mario Stephen Marsan It is certified that error appears in the above-identified patent and that said Letters Patent are hereby corrected as shown below:

Column 12, line 24, "Claim 1" should read -- Claim 17 --.

Signed and Sealed this

Nineteenth Day of April 1977

[SEAL]

*Attest:*

RUTH C. MASON
*Attesting Officer*

C. MARSHALL DANN
*Commissioner of Patents and Trademarks*